US005730522A

United States Patent [19]

Wyke et al.

[11] Patent Number: 5,730,522

[45] Date of Patent: Mar. 24, 1998

[54] LAMPHOLDER MOUNTING SYSTEM

[75] Inventors: Rickie Wyke, Valdese, N.C.; Stanley S. Brenner, East Northport, N.Y.

[73] Assignee: Leviton Manufacturing Co., Inc., Little Neck, N.Y.

[21] Appl. No.: 590,032

[22] Filed: Feb. 2, 1996

[51] Int. Cl.[6] ..... F21S 1/02

[52] U.S. Cl. ..... 362/432; 362/370; 362/457; 439/553; 248/200; 248/300; 248/311.2

[58] Field of Search ..... 439/553; 362/249, 362/396, 432, 226, 370, 457; 248/56, 225.11, 200, 342, 300, 311.2, 312, 312.1, 316.2

[56] References Cited

U.S. PATENT DOCUMENTS

| | | | |
|---|---|---|---|
| 2,277,468 | 3/1942 | Welch | 362/432 |
| 2,352,126 | 6/1944 | Schmitt | 439/553 |
| 5,049,092 | 9/1991 | Takano et al. | 439/553 |
| 5,260,859 | 11/1993 | Lettenmayer | 362/226 |
| 5,469,344 | 11/1995 | Kotsakis | 362/249 |

FOREIGN PATENT DOCUMENTS

| | | | |
|---|---|---|---|
| 1449307 | 8/1966 | France | 439/553 |

*Primary Examiner*—Alan Cariaso
*Attorney, Agent, or Firm*—Paul J. Sutton

[57] ABSTRACT

A lampholder mounting system includes a lampholder and a lampholder bracket. The lampholder includes a housing, electrical contacts supported by the housing and electrical conductors interconnected with the housing to the electrical contacts. The housing includes at least one stop-tab slot and at least one bend-tab slot upon an outer surface of the housing. A lampholder bracket includes a mounting plate with a receiving portion for receiving the lampholder. The receiving portion includes at least one upturned bend tab and at least one stop tab for complementing the outer surface of the lampholder housing, wherein the lampholder is snapped into the receiving portion and the at least one bend tab is bent up to lock the lampholder fixedly to the lampholder bracket.

5 Claims, 5 Drawing Sheets

LAMPHOLDER MOUNTING SYSTEM

BACKGROUND OF THE INVENTION

The present invention relates to a lampholder assembly for use as a wiring device, and more particularly relates to lockable lampholder mounting system for use with recessed incandescent lighting fixtures.

It is well known for fixture assemblies to include one or more sockets which are riveted to a mounting panel to secure the sockets thereto. Utilizing rivets, however, to secure lampholders to a mounting panel, can be quite costly in both assembly time and material cost. Also well known are lockable lampholder mounting systems for use with a variety of wiring devices, sockets, and lampholders in particular. For example, U.S. Pat. No. 4,661,885 to Brenner, et al., commonly owned and incorporated herein by reference, discloses a lampholder system which utilizes a pre-formed and resilient clip means secured to a socket/lampholder in order to mount the socket to a panel or the like. The clip means is formed in a particular shape for mounting and supporting the socket to the mounting surface, including at least three spaced bearing surfaces which concertedly act as a resilient spring member. While the clip means renders rivets unnecessary as a means for securely mounting such lampholders, parts and labor required to build the actual lampholders or assemblies can become a cumulatively large expense. It would be desirable, therefore, to realize a lampholder assembly or system which does not require a socket/lampholder to utilize clip means, a complicated mounting spring arrangement, and/or rivets for attaching a socket/lampholder to a mounting panel, or both, whereby the cost of both the labor and the material for the system is minimized.

OBJECTS AND SUMMARY OF THE INVENTION

It is therefore an object of the present invention to provide a lampholder mounting system which overcomes the shortcomings of the prior art.

It is another object of the present invention to provide a lampholder mounting system which does not require a socket/lampholder to include a mounting spring to mount the socket/lampholder to a panel or bracket.

It is another object of the present invention to provide a lampholder mounting system which does not require the use of rivets to mount a socket/lampholder to a panel or bracket.

It is another object of the present invention to provide a lampholder mounting system which includes a socket/lampholder arranged to snap into a cutout located within a lampholder mounting bracket to fixedly attach the socket/lampholder thereto.

Accordingly, the present invention discloses a lampholder mounting system which provides a socket/lampholder and a lampholder mounting bracket that includes a receiving portion for receiving and securing the socket/lampholder. The mounting bracket includes at least one ear or bend tab at the receiving portion and the socket/lampholder includes one or more slots for mating with the ears. The ear is preferably upturned and/or crimped for securely locking the socket/lampholder into place after its placement upon/attachment to the mounting bracket. Concomitantly, the socket/lampholder may be quickly, easily and securely locked into place upon the mounting bracket with considerable savings in both the material cost of the completed assembly and the labor required to prepare it.

DETAILED DESCRIPTION OF THE PREFERRED EMBODIMENTS

Figure 1A:
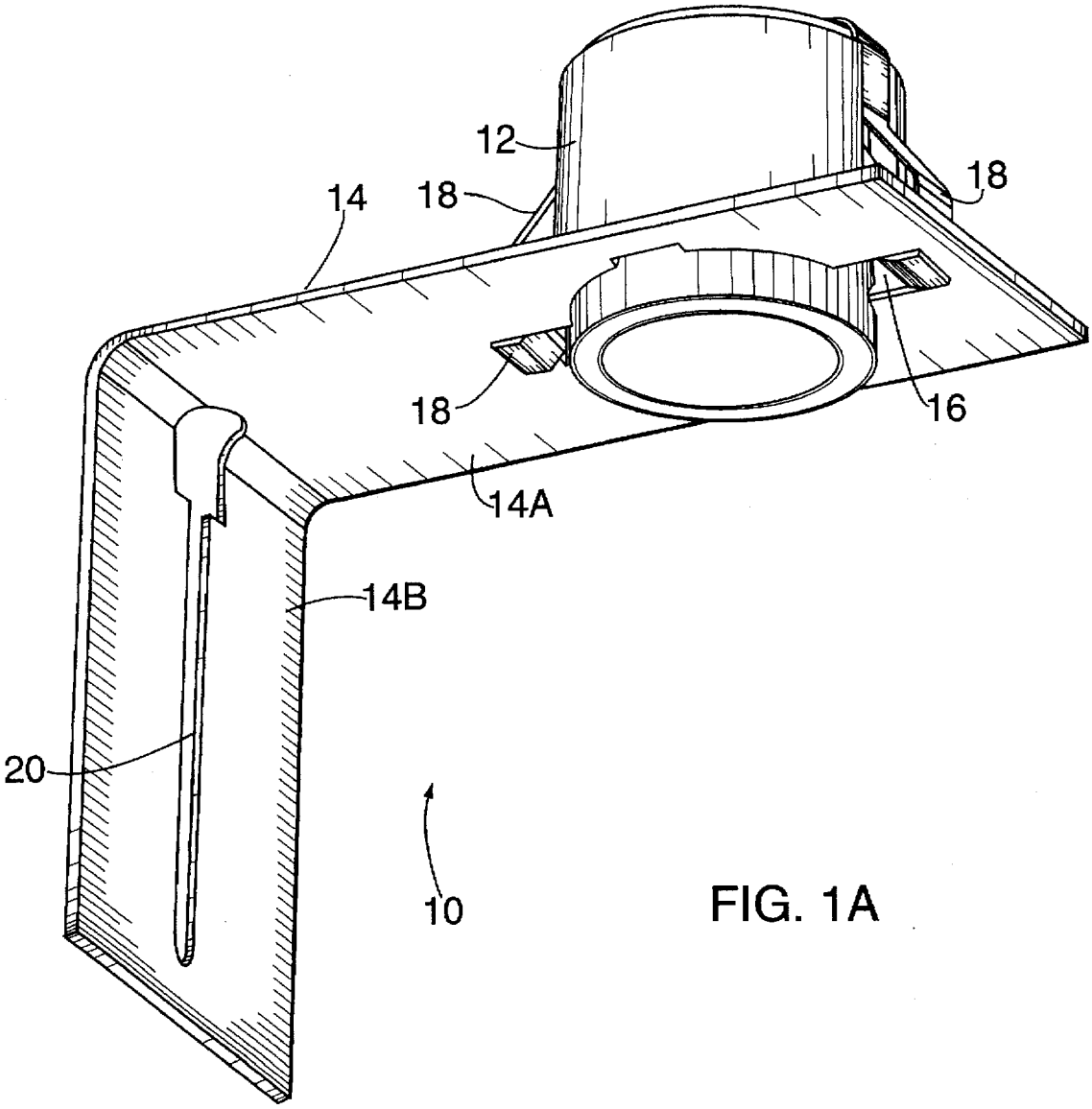
FIGS. 1A and 1B comprise alternative perspective views of a lockable lampholder mounting system of the prior art.
Figure 1B:
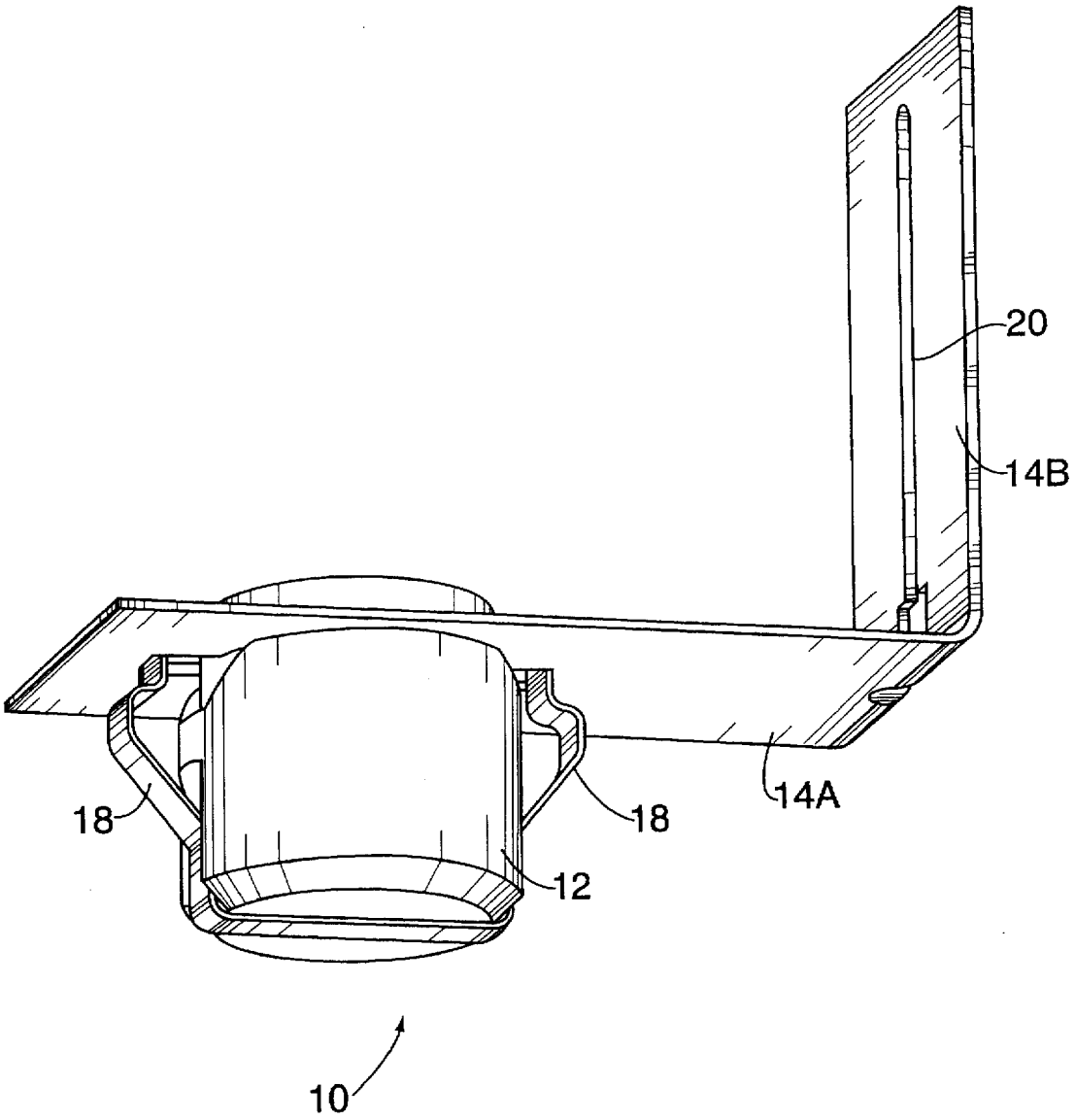
Figure 2A:
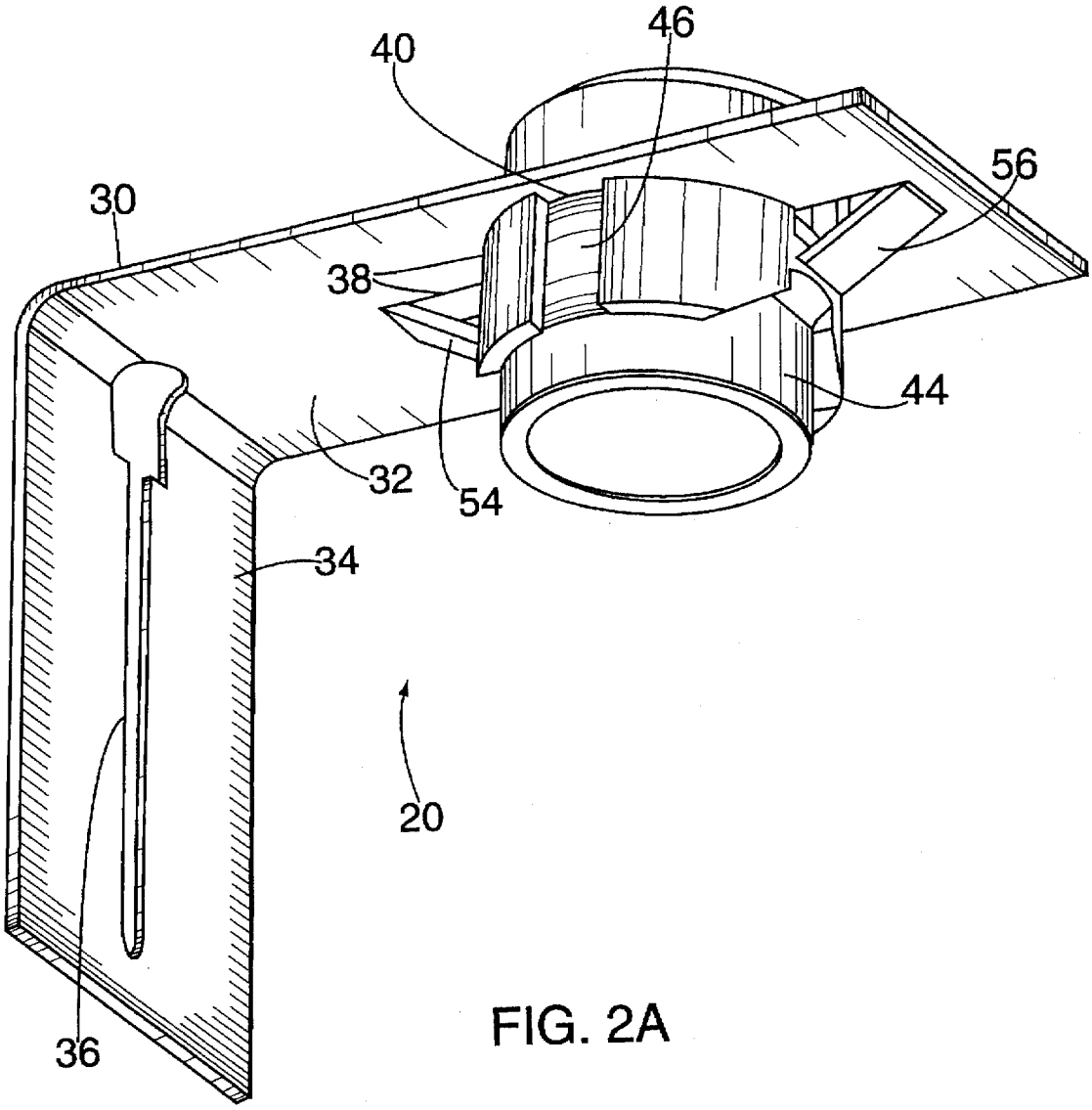
FIGS. 2A and 2B comprise alternative perspective views of a lampholder mounting system of the present invention.
Figure 2B:
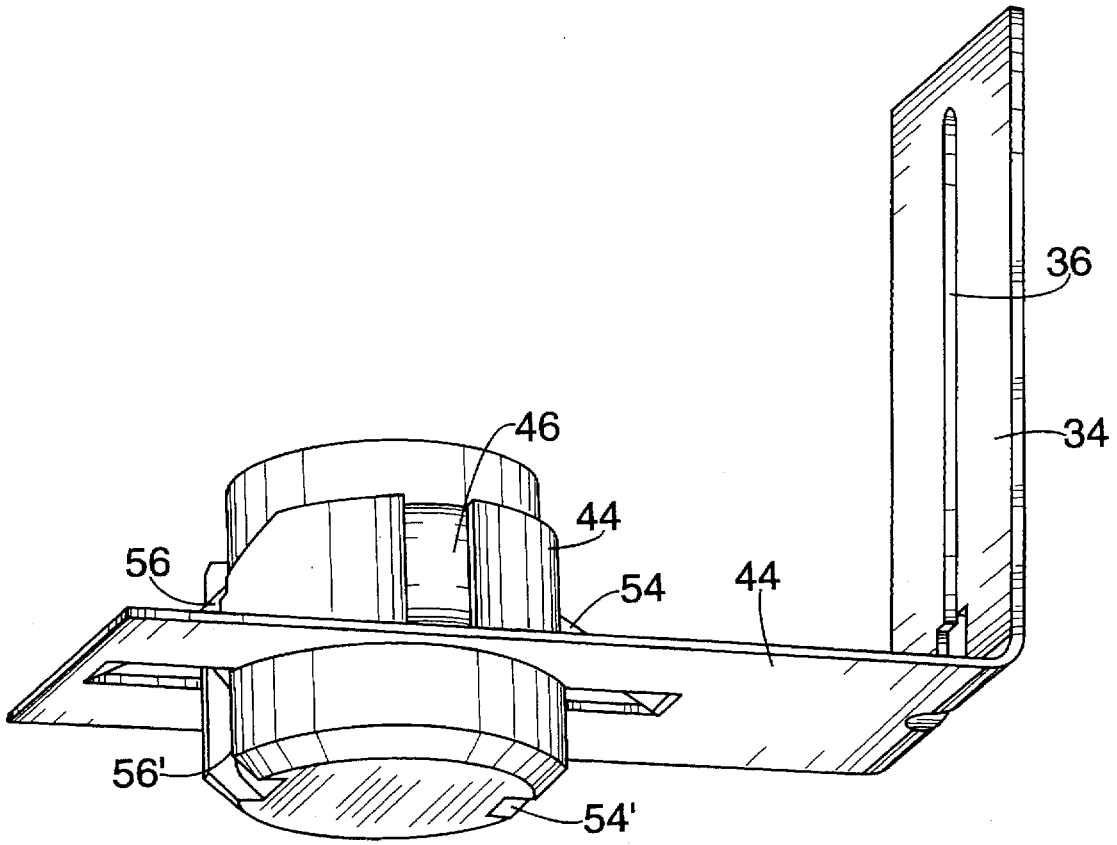
Figure 3A:
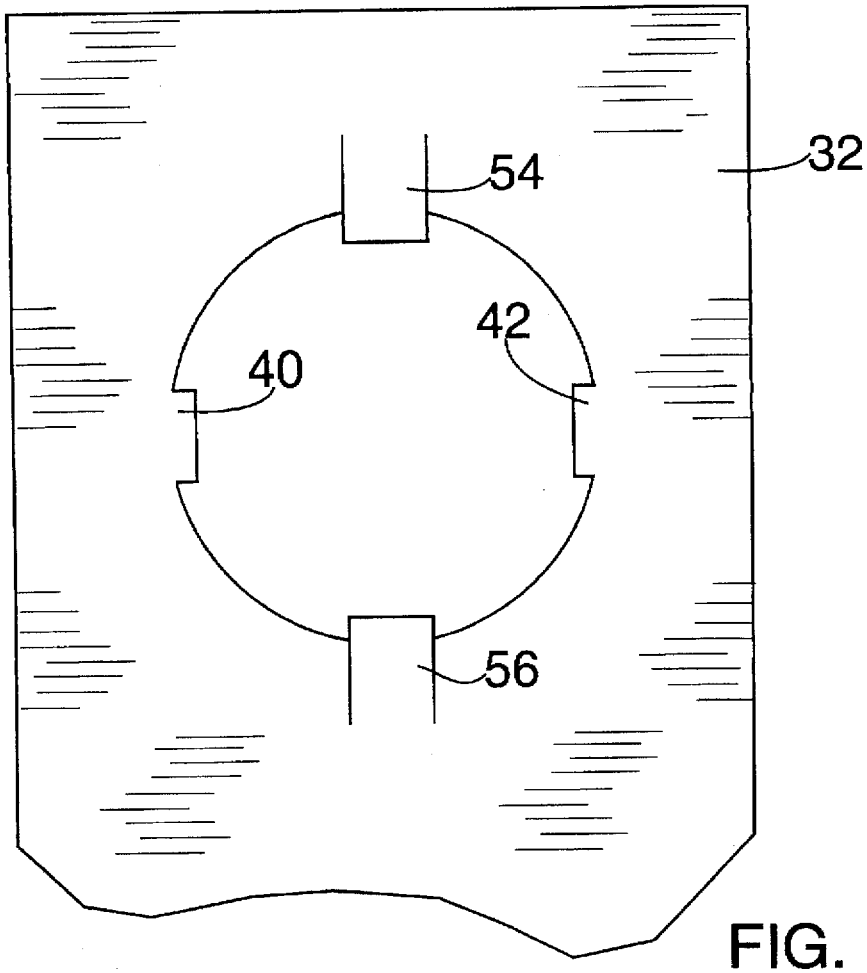
FIGS. 3A and 3B are a top plan and a side cutaway view, respectively, of the embodiment of the invention depicted in FIGS. 2A and 2B.
Figure 3B:
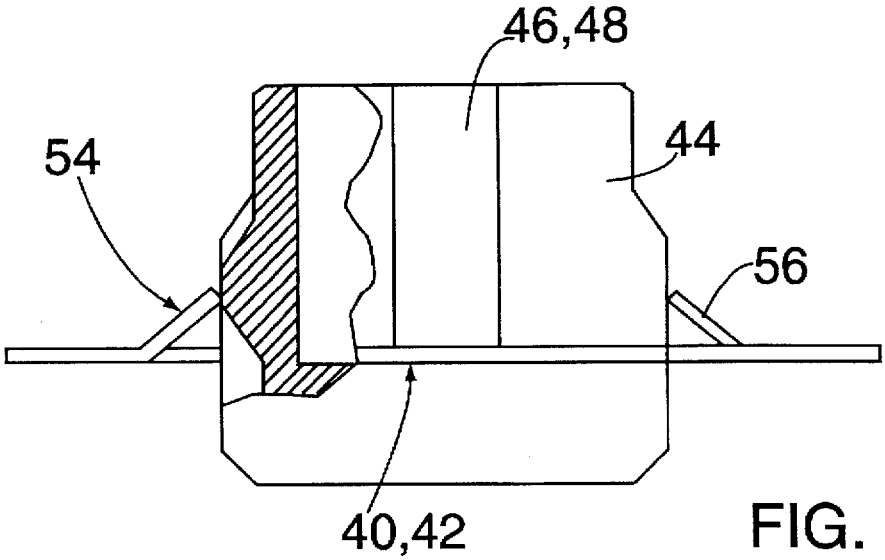

FIG. 1A shows a conventional lampholder assembly 10, used in a lighting fixture commonly known as a Top Hat. The assembly 10 includes a lampholder 12, a mounting bracket 14, a receiving portion or aperture 16 within the mounting bracket 14 for receiving the lampholder and a spring 18 which attaches to the lampholder 12 and snaps into place within the receiving portion 16. In one form, the mounting bracket is formed of two planar sheets which are joined contiguously along one edge in a substantially mutually perpendicular arrangement. The assembled spring 18 securely holds the lampholder 12 in receiving portion 16 of the mounting bracket 14 after the lampholder is positioned in the aperture. A slot 20 is included in mounting surface 14B of bracket 14 for securely mounting the bracket to a fixed position at various points in the slot. Problems do arise, however, in the physical handling of the top lampholder/spring combination to arrange its positioning within the prior art bracket.

A preferred embodiment of a lampholder mounting system 20 of the present invention, which overcomes problems within prior art lampholder assemblies, will now be described with reference to FIGS. 2A, 2B, 3A and 3B. It should be noted, however, that the description provided herein is for illustrative purposes only and is not meant to narrow or limit the scope and spirit of the invention.

Lampholder mounting system 20 of this invention is shown in the figures to include a mounting bracket 30 to which a lampholder 44 may be securely attached. The mounting bracket 30, like the prior art mounting bracket described above, may be formed of two planar sheets or portions which are joined contiguously along one edge in a substantially mutually perpendicular arrangement. Alternatively, the mounting bracket may comprise a single planar sheet which is bent to form the perpendicular arrangement. The two portions may be referred to hereinafter as lampholding portion 32 and mounting portion 34. Mounting portion 34 includes at least one side attachment groove 36; lampholding portion 32 includes at least one receiving cutout 38, as well as at least one bend tab 54, 56. In addition, at least two stop tabs 40, 42 are contiguously attached to a section of a lampholding portion 32 of the bracket relative to receiving cutout 38. The receiving cutout 38, bend tabs 54, 56, and stop tabs 40, 42 may be formed by a punch or any cutout means known to those skilled in the art. Lampholder 44 is also shown in the figures to include at least one stop slot 46, 48, for receiving or mating the at least one of tabs 40, 42, and at least one bend-tab slot 54', 56', through which the bend tabs 54, 56 from the bracket 44 are slid into to secure the lampholders.

The improved attachment ability of the system 20 of the present invention will now be explained. The lampholder 44 "snaps" into receiving cutout 38 within the lampholder portion 32 of the lampholder mounting bracket 30 after the bend tabs 40, 42 are matingly slid into respective bend-tab slots 54', 56'. After the lampholder is "snapped" into place on the bracket 30, the bend tabs 54, 56 are preferably bent up or crimped to solidly affix the lampholder 44 to lampholding portion 32 of the bracket 30. Concomitantly, the stop tabs 40, 42 are locked into place within slots 46, 48. The mounting and locking as described herein is quick and easy, and leads to a very secure attachment.

Accordingly, mounting spring mechanisms or riveting means normally required to secure a lampholder, such as lampholder 44, to a mounting bracket, such as mounting bracket 30, and labor required for assembling the same, are minimized using the present invention. The lampholder tabs 40, 42, 54 and 56, and corresponding slots 54', 56', 46 and 48 provided in the complimentary lampholder and mounting bracket of this invention provide for a secure tab-lock fit and tab crimping to secure the bracket to the lampholder. The invention, therefore, is a cheap labor-saving solution to the inferior and costly prior art lampholders and lampholder mounting/locking assemblies and methods. It should be noted, however, that due to the step of crimping of bend tabs 54, 56, the lampholder 44 cannot be serviced by itself, but must be replaced as an assembly which includes the bracket 30 if one or more of its parts become non-functional.

The above embodiment has been described for illustration purposes only and is not meant to limit the scope and spirit of this invention.

What is claimed is:

1. A lampholder mounting system, comprising:

a lampholder having a housing, electrical contacts and electrical means for interconnecting said contacts and said housing, wherein at least two stop-tab slots and at least two bend-tab slots are arranged on an outer surface of said housing; and a mounting bracket comprising a mounting portion and a lampholding portion, wherein said mounting portion includes at least one attachment groove, and wherein said lampholding portion includes a cutout for receiving said lampholder, said cutout including at least two upturned bend tabs and at least two stop tabs for complementrary engagement with said slots on said outer surface of said lampholder housing such that said lampholder may be efficiently snapped into said cutout and said at least one bend tab may be crimped to fixedly lock said lampholder to said mounting bracket.

2. The lampholder defined by claim 1, wherein said mounting bracket comprises a planar shape.

3. The lampholder defined by claim 1, wherein said mounting portion and lampholding portions are formed as two distinct planar sections of a contiguous planar sheet.

4. The lampholder defined by claim 3, wherein said planar sections are substantially mutually perpendicular.

5. A mounting assembly comprising:

a. mounting panel comprising a device holder portion including a closed, circular cutout and a mounting means for securely attaching said mounting panel to a mounting location; and b. an electrical device for attachment to said mounting panel, said electrical device comprising a device housing, electrical contacts, supported by said device housing, and electrical means interconnected with said device housing for electrically connecting said contacts to a source of electrical power and at least one bend tab on said device holder portion adjacent said cutout and at least one bend-tab slot disposed in an outer surface of said device housing to receive said at least one bend tab therein to permit said device housing to be advanced along said at least one bend-tab slot but prevents the removal of said device housing from said device holder portion wherein said electrical device is positioned within said cutout such that said at least one bend tab is included within said cutout and securely attaches said electrical device to said mounting panel.

* * * * *